US005944452A

United States Patent [19]

Reinert, Sr.

[11] Patent Number: 5,944,452

[45] Date of Patent: Aug. 31, 1999

[54] HEAVY DUTY FOUNDATION INSTALLATION APPARATUS AND METHOD

[76] Inventor: Gary L. Reinert, Sr., 130 Seventh St., Pittsburgh, Pa. 15222

[21] Appl. No.: 09/050,630

[22] Filed: Mar. 30, 1998

[51] Int. Cl.[6] ..... E02D 7/00; E02D 17/02

[52] U.S. Cl. ..... 405/232; 173/184; 173/188; 175/171; 405/229; 405/303

[58] Field of Search ..... 405/232, 231, 405/229, 244, 303; 175/171, 162; 173/184, 186, 187, 188, 193, 42, 44, 28, 24, 26; 52/115

[56] References Cited

U.S. PATENT DOCUMENTS

| | | | |
|---|---|---|---|
| 3,621,910 | 11/1971 | Sanford | 175/171 X |
| 3,864,923 | 2/1975 | Turzillo | 405/232 |
| 3,869,003 | 3/1975 | Yamada et al. | 405/232 |
| 4,193,459 | 3/1980 | Engstrom | 405/245 X |
| 4,296,821 | 10/1981 | Larson | 175/171 X |
| 4,809,788 | 3/1989 | Nelson | 173/42 X |
| 4,813,496 | 3/1989 | Rohweller et al. | 175/171 X |
| 5,104,264 | 4/1992 | Castagner et al. | 405/232 X |
| 5,232,268 | 8/1993 | Dengler et al. | 173/184 X |
| 5,269,107 | 12/1993 | Klemm | 52/115 |

FOREIGN PATENT DOCUMENTS

| | | | |
|---|---|---|---|
| 0363044 | 10/1981 | Australia . | |
| 0794556 | 2/1936 | France . | |
| 2534292 | 4/1984 | France . | |
| 0089527 | 7/1980 | Japan | 405/232 |
| 0223217 | 9/1988 | Japan | 405/232 |
| 0223218 | 9/1988 | Japan | 405/232 |
| 0146015 | 6/1989 | Japan | 405/232 |
| 0260117 | 10/1989 | Japan | 405/232 |
| 0767285 | 9/1980 | Russian Federation | 405/254 |
| 0861476 | 9/1982 | Russian Federation | 405/232 |
| 2060742 | 5/1981 | United Kingdom . | |
| WO-A93/21393 | 10/1993 | WIPO . | |

*Primary Examiner*—Dennis L. Taylor
*Attorney, Agent, or Firm*—Douglas G. Glantz

[57] ABSTRACT

Heavy duty mobile metal foundation installation apparatus and method are disclosed including a push-it carriage movably supported through controllable positioning to push a metal foundation into the ground by hydraulic cylinders pushing against a header frame held and secured in adjustable positions on a heavy duty mobile push-it tower. The heavy duty mobile push-it tower and metal foundation holder and push-it carriage mounted on the heavy duty tower are attached to a track roller frame tractor structure. The push-it tower is attached to the track roller frame tractor structure by a hydraulically activated tractor boom arm, a pivot point on the tower, and a hydraulic cylinder for rotating and positioning the tower about the pivot attachment point.

20 Claims, 6 Drawing Sheets

24
31
47
6
35
7
5
47
31

8
7
6
11
10
11a
11a
9
12
12
31
31
8
31
31
6
6
31
31
17
17
5
18
2
15
20
14
13

28
27
15
110
42
36
22
43
34
36
101
34
106
21
2
26
24
19
35
5
46
3
37
38
4
58

HEAVY DUTY FOUNDATION INSTALLATION APPARATUS AND METHOD

BACKGROUND OF THE INVENTION

1. Field of the Invention

The present invention relates to structural foundations including earth anchors for supporting airport and roadway signs, utility poles, communication towers, and the like and installation apparatus and methods for such structural foundations.

2. Background

By conventional methods, a concrete foundation, also called a concrete pier or pad, is utilized for the installation of various types of structures, e.g., signs, high mast lighting and utility poles, communications towers, and the like. A concrete pad or pier is utilized for its mass to provide a structural foundation for supporting such structures.

These structures are attached to the concrete pier or pad by means of bolts or threaded anchors which are set to the required elevation in a rebar cage prior to pouring the concrete in forms.

In the installation of such a concrete pier or pad by the conventional method, site layout is performed, equipment is deployed, the site is excavated, the spoils are removed, and a stone sub-base sometimes is placed in the excavated hole. The work requires a backhoe, a truck, and equipment operators as well as the engineer and one or more laborers depending on the size of the job. Materials, such as the stone for the sub-base, are also required. In the case of some installations, e.g., in airport runway work, all construction debris and equipment must be removed from the work site by the end of each work day.

Then pouring forms are built, a rebar mat is installed, bolts or threaded anchors are attached to the rebar at the required elevation, and the concrete pad is poured. This work requires a carpenter, a laborer, and the material, i.e., concrete, forms, test equipment, bolts, and rebar mats. Again, in the case of airport runway work, all construction debris and equipment must be removed from the site at the end of the work day.

Next, the forms must be stripped, and back-filling around the foundation takes place. This work requires a backhoe, the operator, a carpenter, a laborer, and materials used to back-fill and seed the area.

The conventional method requires the concrete to cure for about seven (7) days. This concrete curing sometimes takes longer depending on the type of concrete used. If testings show the concrete not to comply with a specified strength within the first seven (7) days, then it is required to wait twenty-eight (28) days before any structure can be installed upon the concrete.

Bolts or threaded anchors are used for the installation of structures on the foundation. The structures are installed after the concrete has cured. Accordingly, several days are required to install the concrete foundation and to place the structures into operation.

In the case of airport runway work, on the eleventh day, the concrete pad is drilled to provide holes for the installation of the concrete anchors. These concrete anchors are utilized for the installation of the anchor bolts which will be used for installing the airport runway sign upon the foundation. The sign then is installed and energized at this time through work performed by electricians. Accordingly, eleven days have been required to install and illuminate the airport runway sign.

From the description of the conventional method of installation for a structure supported by a concrete foundation, some of the major drawbacks of the conventional installation method are apparent. These drawbacks include prolonged roadway area closure time in the case of a roadway sign, utility pole, or high mast lighting pole, prolonged runway and taxiway closure time in the case of airport signs, and lengthy installation times. These drawbacks further include increased labor costs, weather dependent operation, and an increased risk of debris falling on the roadway or aircraft traffic areas (in the case of airport installations) attributable to the many truck trips required. These drawbacks and others are eliminated or substantially reduced by installing a metal sign or utility pole foundation.

INTRODUCTION TO THE INVENTION

The metal foundation is structurally and geo-technically engineered to provide the equivalent of a concrete foundation for each specific application. The metal foundation is completely coated with hot dip galvanizing for corrosion protection. For further protection in extremely corrosive soils, the metal foundations can be supplied as hot dip galvanized with an additional overall bitu-plastic coating. The metal foundation typically can include, e.g., in one embodiment, a length of standard schedule 40 pipe column with a number of longitudinal fins continuously welded to the entire length and to which a steel plate has been continuously welded to the top.

The metal foundation is installed by a simple, yet revolutionary method. The metal foundations are pressed into the soil, and no excavation is required.

On the same day, utilizing the metal foundation and installation method, a roadway or airport sign or utility pole, high mast lighting pole, or communications tower foundation can be set into the soil. The metal foundation provides a top plate upon which the structure can be installed. The foundation's top plate is pre-drilled to accept the structure's mounting bolts. The foundation is installed in the first hours of the work day, while in the later occurs of the same work day, the structure is installed, wired, and energized. The installation requirements call for installation equipment, the metal foundation, and a crew of two pile drivers and one operator during the first hours of the work day, and electricians and materials in the final hours of the same day.

The metal foundation and installation method allow the entire installation to be performed in only one day, with one trip to the structure installation site. In the amount of time required to install one concrete foundation by the traditional method for airport sign foundations, eleven conventional metal foundations can be installed. In addition, all eleven foundations would have been installed at a lower cost and with a greater level of safety. Airfield closure time can be dramatically reduced.

Moreover, the metal foundation can be reused. If it becomes necessary to relocate a structure, the metal foundation can be removed and reinstalled at the new location. This removal and reinstallation provides not only a significant cost savings, but it removes any hazard associated with abandoned concrete piers or pads.

Metal foundations are engineered for specific applications. Some of these applications include high mast lighting poles, traffic lights, roadway sign or utility poles, airport signs, commercial signs and billboards, power distribution and communications towers, retaining walls, and many others.

The design of metal foundations is based on engineering calculations backed by independent, registered professional engineers and by extensive testing. For the calculations of the structural capacities, each foundation can be designed to take into consideration the geo-technical characteristics of the soil into which it will be installed, i.e., soil density, shear strength, plasticity, moisture content, and grain size.

Each metal foundation can be designed to exceed the load requirements of the structure which will be installed upon it. These loads are in four basic modes including (1) overturning moment capacity, (2) torsional moment capacity, (2) compressive load capacity, and (4) uplift capacity. Deflection limits are also calculated where applicable.

Metal foundations typically include, e.g., by way of illustration, a length of schedule 40, A-53 carbon steel pipe, six inches or larger in diameter. Three or four longitudinal fins, e.g., fabricated from A-36 carbon steel plate of the required thickness, are continuously welded to the pipe. These longitudinal fins are positioned 120 degrees from each other in the case of three fins or 90 degrees in the case of four fins. A carbon steel plate of the required thickness is continuously welded at the top of the pipe column and to the top end of the fins and is drilled and tapped to accept the mounting plate of the structure to be supported by the foundation.

In the case of airport signs and depending on the overall length of the sign, two foundations may be required, and a second "sign plate" may be required also. The length and width of the second steel plate depends upon the length and width of the airport sign as measured at its base. In the case of more than one foundation, the "sign plate" is bolted to the top plate of each foundation. All structural dimensions are calculated on the basis of the loads to be supported by the foundation.

Prior to attaching the airport sign to the foundation, a steel or plastic boot can be bolted onto the foundation top plate. This plastic boot can be approximately six inches larger than the sign base, and it stands one and one half inches above grade. The boot is designed and installed to prevent damage, e.g., damage from mowers, to the sign.

The airport sign foundation plate and boot can be drilled and tapped to accept a PVC conduit adapter which is male threaded on one end where it attaches from the bottom to the sign foundation plate and female, PVC to PVC, at the other end. This enables the attachment of a length of PVC conduit to connect the sign to a junction box. In the case of other structures, an opening is provided at the top of the foundation pipe column for a conduit bringing electrical wiring to penetrate inside the structure for actual wiring or electrical connections. These arrangements allow easy wiring for energizing the structure.

The installation of the metal foundation involves pushing the foundation into the soil. This pushing method typically uses an anchor as a reaction point. An anchor at the end of a rod is dropped to the bottom of a shaft augered into the ground. The anchor is pre-stressed by expanding its four radial plates against the soil while compressing it, all done by hydraulic force. The reaction point so established then is utilized for pushing the foundation into the ground by hydraulic forces.

After pushing the foundation into the soil to the desired elevation, in the case of an airport sign foundation, a PVC connector is threaded into the sign foundation plate which is required to be factory drilled and tapped for that purpose. The airport sign foundation plate is welded to the foundation top at the factory. A plastic boot is bolted to the sign foundation plate after the foundation is installed. The airport sign then can be installed on the foundation by bolting it onto the foundation top plate, and then the wire can be installed. The airport sign is then energized. All work can be performed and completed in one day.

In the case of all other types of structures after pushing the foundation into the soil, a conduit is inserted through a small opening at the top of the pipe column below its top plate. This conduit will be used to pull electrical wires through it so as to bring power to the structure to be mounted upon the foundation.

Representative metal foundations, i.e., lighting pole foundations, are shown in Sero et al. U.S. Pat. No. 4,974,997 and Collins U.S. Pat. No. 5,234,290. The Sero et al. patent and the Collins patent show hydraulically pushing a prefabricated longitudinally-finned cylindrical metal foundation into a pre-augered hole in the ground. The Sero et al. patent and the Collins patent use a central anchor as a reaction point against which the hydraulic cylinders work. Hydraulic cylinders pushing against an I-beam can be held down by outboard or satellite anchors.

Conventional metal foundation installation methods require a preliminary angering step, a separate crane to move the foundation into position and to move the hydraulic pushing mechanism into position, and a central anchor inside the foundation, which anchor generally is removed after the metal foundation is installed in the ground. These many separate steps must be repeated every time the position or angle of the foundation is changed.

U.S. Pat. No. 4,626,138 discloses a non-impacting pile driver mounted on a low-boy wheeled trailer having ground engaging means. A mast of a spaced apart pair of upright wide-flange I-beams is adapted to have guide rails for slidably guiding a hydraulic ram carriage. The carriage has a sturdy transverse header for receiving the upward reaction force of the hydraulic ram. A pile engaging element has a configuration depending on the type of pile to be driven. The carriage cooperates with a latch means which allows the ram to push the pile step by step. The latch means locks the carriage to the mast at each of a series of locations that are spaced apart vertically. Plunger-like latch members at each side of the carriage are each movable horizontally toward and from locking engagement with abutments on the mast. A double-acting hydraulic cylinder actuates movement for each latch member into the abutments on the mast which are preferably defined by annular collars having inside diameters to slidably receive the latch members.

U.S. Pat. No. 3,869,003 discloses an auger fitted in the hollow portion of a pile to excavate the ground beneath the pile while simultaneously forcing down the pile by a hydraulic pressure device. A tower or leader mast includes a pair of reaction receiving brackets provided vertically at suitable intervals. A pair of hydraulic cylinders push against a structure to push the pile downward, and stoppers engage the corresponding lower faces of the reaction-receiving brackets.

U.S. Pat. No. 5,145,286 discloses a vehicle mounted anchor installer and swinging truck mounted boom.

U.S. Pat. No. 4,637,758 shows developments in placing an auger inside a hollow pile and rotating the auger to excavate the earth in the leading end of the pile.

U.S. Pat. No. 5,018,905 discloses a mobile vehicle or truck mounted core drilling equipment including controls. The drill bit and pipe string used to drill the bore may be used as a piling.

Japanese 62-304868 discloses what appears to be a hydraulic pile pusher driver combined with earth boring and outboard earth anchoring means. Setting and penetrating the pile and excavation is disclosed as can be performed by the same apparatus, thereby permitting construction to be simplified.

Japanese 63-88557 discloses augering so that a hollow pile can be driven without discharging soil, and outboard anchors 52.

Japanese 53-162604 discloses a general combination with outboard anchoring means.

USSR 774418 discloses outboard anchors 5 on support girder 3.

USSR 767285 discloses piles 8 guided by sleeves 9.

U.S. Pat. No. 3,869,003 discloses a pile driver.

Japanese 53-162604 discloses a pile driver and outboard anchors.

U.S. Pat. Nos. 5,570,975, 5,660,504, and 5,733,068 disclose mobile metal foundation installation apparatus and methods.

It has been found, in accordance with the present invention, that the current technology of metal foundation installation equipment and methods is augmented by the development of a novel heavy duty mobile tractor-mounted metal foundation installation machine for positioning and installing prefabricated, longitudinally-finned, cylindrical metal foundations into the ground by pushing the metal foundations through pushing forces provided by such a novel heavy duty mobile tractor-mounted metal foundation installation machine.

It is an object of the present invention to provide a heavy duty mobile metal foundation push-it and installation apparatus and method.

It is an object of the present invention to provide a heavy duty mobile metal foundation push-it, positioning, and installation apparatus and method.

It is a further object of the present invention to provide a heavy duty mobile metal foundation push-it, positioning, and installation apparatus and method which do not use or require a preliminary and separate augering step.

It is yet another object of the present invention to provide heavy duty mobile metal foundation push-it and installation apparatus and method which do not use or require a separate crane to position the foundation for installation into the ground.

It is yet another object of the present invention to provide heavy duty mobile metal foundation push-it, positioning, and installation apparatus and method which do not use or require all the numerous steps of moving the anchor and the foundation into position.

It is another object of the present invention to provide heavy duty mobile metal foundation push-it, positioning, and installation apparatus and method which do not use or require all the numerous steps of moving the anchor and the foundation into position and moving the hydraulic pushing mechanism into and out of position.

It is another object of the present invention to provide heavy duty mobile metal foundation push-it and installation apparatus and method which do not use or require a central anchor inside the foundation.

It is another object of the present invention to provide heavy duty mobile metal foundation push-it, positioning, and installation apparatus and method which provide important advantages of efficiency and productivity for positioning and installing metal foundations inserted into the ground.

These and other objects of the present invention will be described in the detailed description of the invention which follows. These and other objects of the present invention will become apparent to those skilled in the art from a careful review of the detailed description and from reference to the figures of the drawings.

SUMMARY OF THE INVENTION

The present invention provides heavy duty mobile metal foundation installation apparatus and method including a heavy duty push-it tower, a metal foundation holder and a push-it carriage mounted on the heavy duty tower, and a track roller frame tractor structure. The push-it tower is attached to the track roller frame tractor structure by a hydraulically activated tractor boom arm, a pivot point on the tower, and a hydraulic cylinder for rotating and positioning the tower about the pivot attachment point.

DETAILED DESCRIPTION

The present invention includes a novel heavy duty mobile, metal foundation push-it, positioning, and installation machine for positioning and installing prefabricated, longitudinally-finned, cylindrical metal foundations into the ground by positioning and pushing the metal foundations through positioning and pushing forces provided by hydraulic cylinders mounted on the tower. In one aspect, the heavy duty mobile metal foundation push-it and installation machine is mounted on a tractor.

The present invention includes apparatus and method for providing a novel metal foundation push-it and installation machine which includes a tractor-mounted tower for holding a push-it carriage including metal foundation holder and auger. The novel machine and method of the present invention augers a hole and installs the metal foundation in one step as the push-it carriage is pushed toward the ground.

Hydraulic pushing cylinders push against a header frame held in adjustable side bar securing positions on the tower, i.e., the hydraulic cylinders push against a bar secured to each side frame of the tower. After the hydraulic cylinders extend to a maximum extension, the bar can be advanced to a lower position in the side frame of the tower, and the hydraulic cylinder assembly is lowered so that it can push against the bar in its lower position.

The present invention includes apparatus and method for providing a novel metal foundation push-it and installation machine which includes outboard or satellite anchors to hold down the tractor when the foundation is pushed into the ground. A tractor-mounted extensible satellite anchor augering guide and anchor structural support extends and retracts on both sides of the tractor.

The present invention includes apparatus and method for providing a novel metal foundation push-it and installation machine and method which do not use or require a preliminary and separate augering step, a separate crane to move the foundation into position or to move the hydraulic pushing mechanism into position, or a central anchor inside the foundation.

The present invention in one aspect provides an apparatus and method for pushing into the ground a pipe-column-type foundation with or without longitudinal fins alongside the pipe column.

Figure 1:
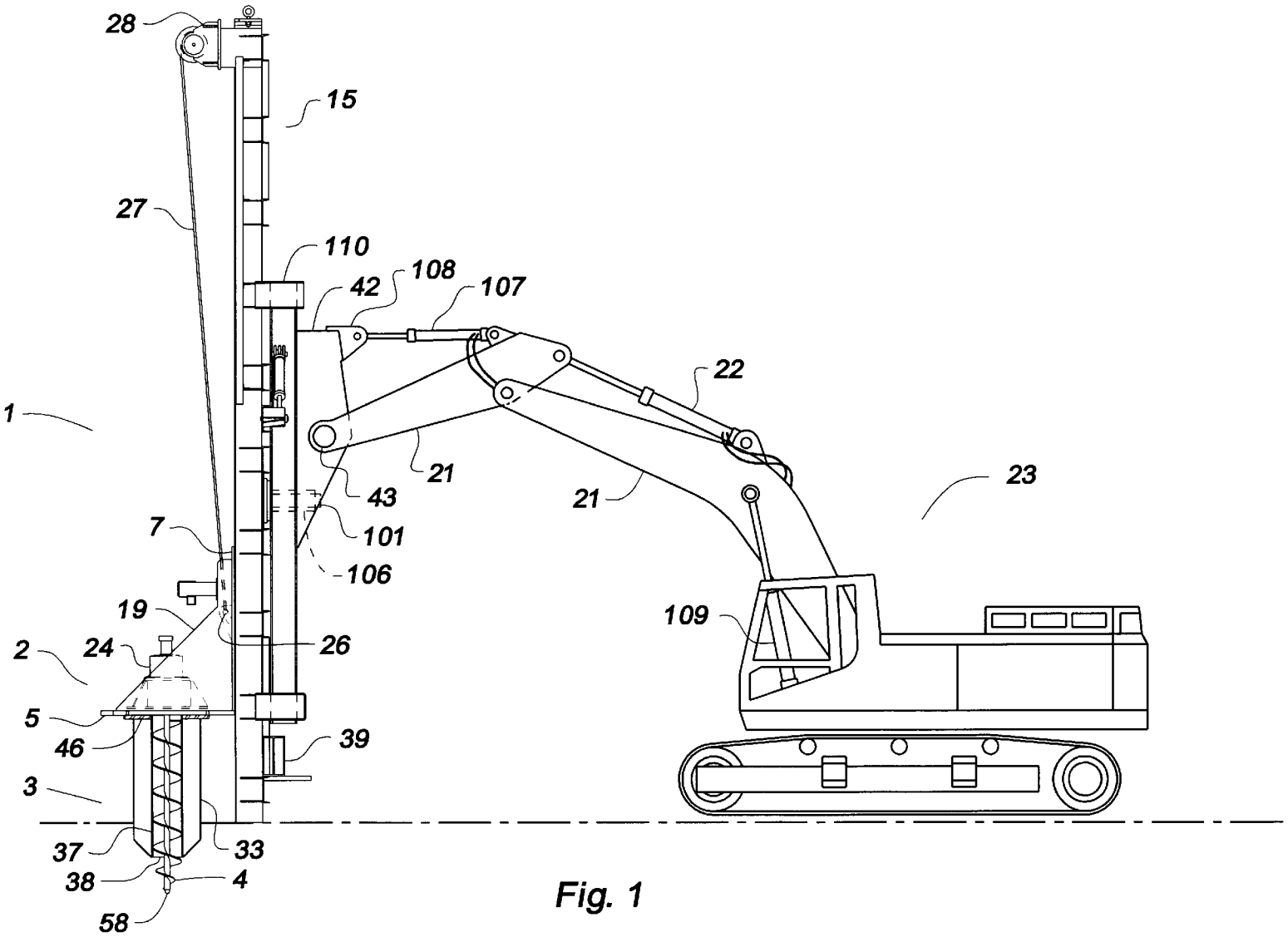
FIG. 1 is a side elevation view of a tractor and tower apparatus for installing a pipe foundation in the ground in accordance with the present invention.

FIG. 1 shows a side elevation view of a tractor and tower apparatus for installing a pipe foundation in the ground in accordance with the present invention. FIG. 1 shows a pivoting structural support tower in its operating position, its pivoting pin, and the tractor boom's hydraulic cylinders with their respective tower positioning piston rods. FIG. 1 shows a pushing/augering carriage with its reinforcement plates, its lower pushing plate, its sliding back-plate, its lifting mechanism, and a hydraulic motor for augering. FIG. 1 shows a finned pipe foundation with an auger inserted into its pipe column, both mounted on the carriage.

Referring now to FIG. 1, metal foundation push-it and installation machine 1 is provided with pushing/augering carriage 2, which is utilized for pushing a pipe-column-type foundation 3 into the ground while concomitantly augering an earthen hole by means of auger 4. Carriage 2 pushes on foundation 3 through lower pushing-plate 5. Carriage 2 has sliding back plate 7 for sliding on tower 15. Lifting bar 26 is pulled by cable 27 operated by winch 28.

Structural support tower 15, shown in the working mode, i.e., vertically, is a pivoting tower, i.e., it can be swung and positioned by means of tractor booms 21, pivoting plate assembly 42, and pivoting pin 43. Tower 15 is initially positioned by means of tractor booms 21 with hydraulic cylinders 22, 107, and 109. This positioning of tower 15 is performed by an operator in tractor 23.

Tower 15 is transported to the foundation installation site separately from the tractor 23. Tower 15 then is attached to tractor 23 at the foundation installation site.

Tower 15 can be positioned and moved for short distances while attached to tractor 23. Tower 15 is lowered forward, ahead of tractor 23 by positioning of tractor boom arms 21 and hydraulic cylinders 22, 107, and 109.

The combination of tractor arms 21, hydraulic cylinders 22, 107, and 109 is utilized to set tower 15 in a vertical position. Alternatively the tower can be tilted to put a foundation into the ground at an angle from the vertical. Cylinder 107 is pivotally connected to attachment plate assembly 108 and provides the final front to back adjustment to the vertical. Cylinder 102 (FIG. 6 and FIG. 8) and piston 103 provide the final left to right adjustment to the vertical position.

Pin 101 is attached firmly to tower 15 by weldments. Bushing 106 is attached firmly by weldments to tractor adapter assembly 42.

Figure 6:
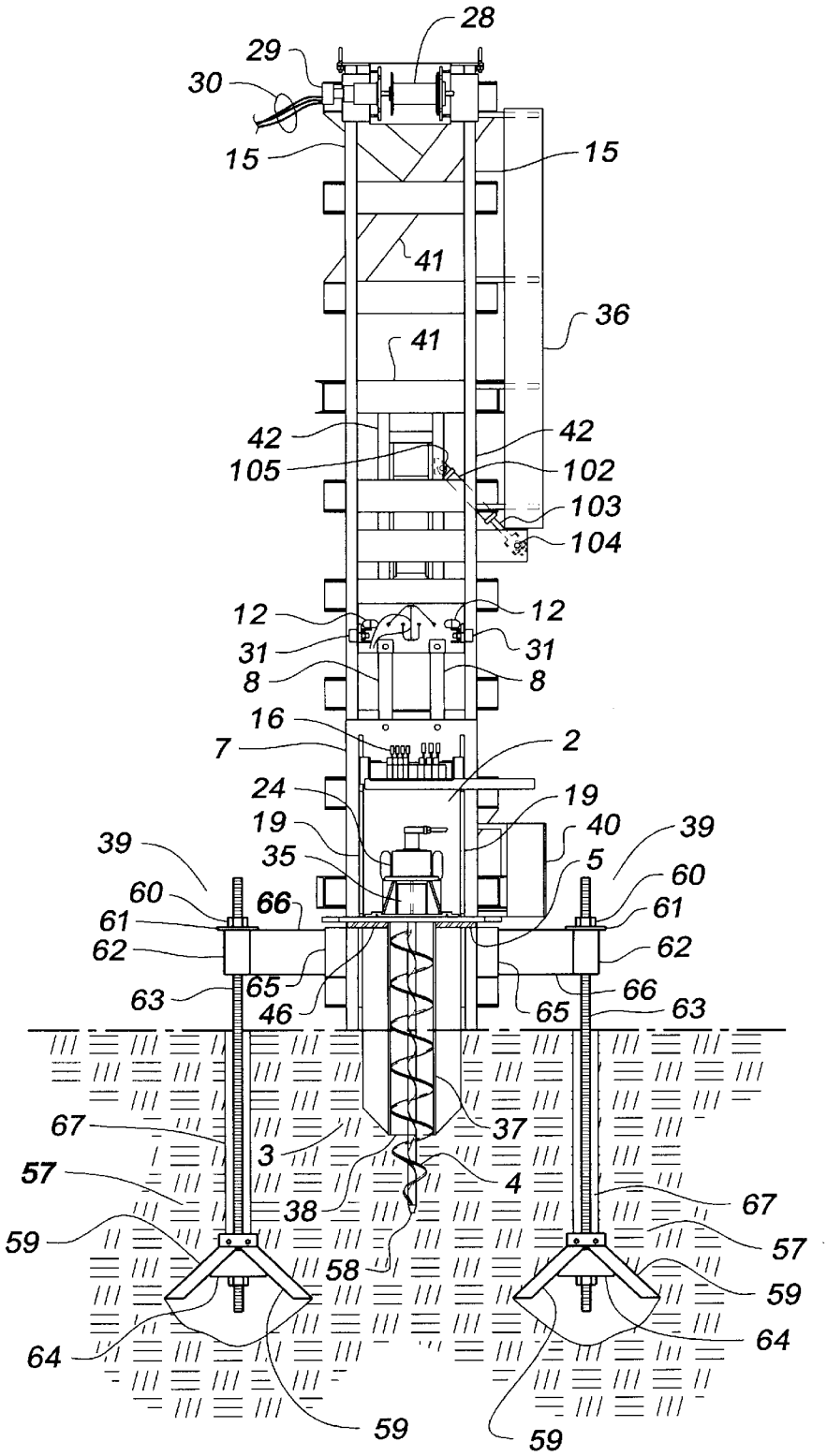
FIG. 6 is a front elevation view, of the apparatus of the present invention in the process of installing a pipe foundation and showing a cut-away view of two satellite anchors.
Figure 8:
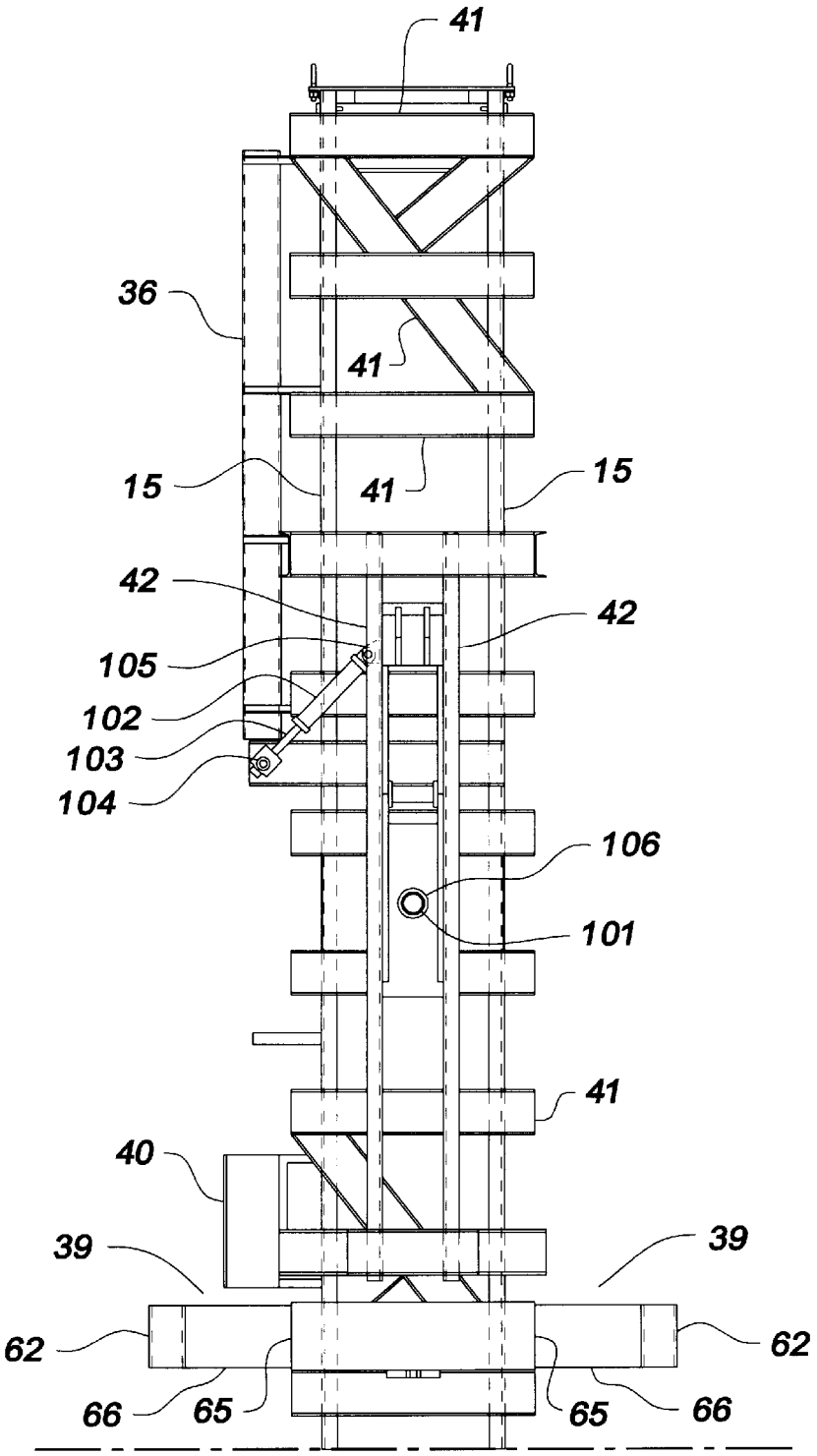
FIG. 8 is a rear elevation view of a tower apparatus for installing a pipe foundation in the ground in accordance with the present invention, partially showing the tractor attachment point and hydraulic positioning apparatus.

Tower 15 rotates to the left or the right in relation to a fixed point of attachment 106 to tractor adapter assembly 42. The rotation is produced by hydraulic cylinder 102, piston 103, attached to tower 15 at point 104 and to tractor adapter assembly 42 at anchor point 105 as shown in FIG. 6 and FIG. 8.

Tractor adapter 42 is attached to tractor 23 by means of tractor booms or arms 21. Tractor booms or arms 21 provide a fixed, anchored assembly which allows tower 15 to rotate forward and backward about pivoting pin 43 for the purpose of precise positioning of tower 15.

Tower 15 rotates only in increments of only a few degrees to the left or the right when piston 103 is retracted into or out of hydraulic cylinder 102.

When hydraulic cylinder 102 retracts piston 103, tower 15 rotates a few degrees to the left. When hydraulic cylinder 102 extends piston 103, tower 15 rotates a few degrees to the right.

An operator has the ability to actuate hydraulic cylinder 102 in one direction or in the opposite direction by means of a remote control box (not shown). All hydraulics are operable from a remote control box or from on board levers 16 on the tower itself.

The rotation of tower 15 a few degrees to the left or to the right at 106, provided by hydraulic cylinder 102 combined with forward and backward movement capability at pivoting pin 43, provided by hydraulic cylinders 22, 107, and 109, allows the operator to set tower 15 in a precise position. The positioning may be in a precise vertical position or, if desired, at an angle with respect to the vertical.

Pushing/augering carriage 2 has reinforcing plate 19 and hydraulic motor 24 mounted on the top surface of its lower pushing plate 5. Hydraulic motor 24 provides the power for augering an earthen hole by means of auger 4, ahead of the advance of bottom 38 of foundation 3, into the soil as foundation 3 having top plate 46 is pushed downward into the ground by pushing/augering carriage 2.

Foundation 3 can incorporate fins 33 along side pipe column 37. Foundation 3 also may be installed without fins 33. Auger 4 extends at bottom 58, e.g., by way of illustration, approximately two feet beyond bottom end 38. Carriage 2 having lower pushing-plate 5 pushes on Foundation 3. Uplift resistance is provided at 39.

Figures 2, 3, 4, 5:
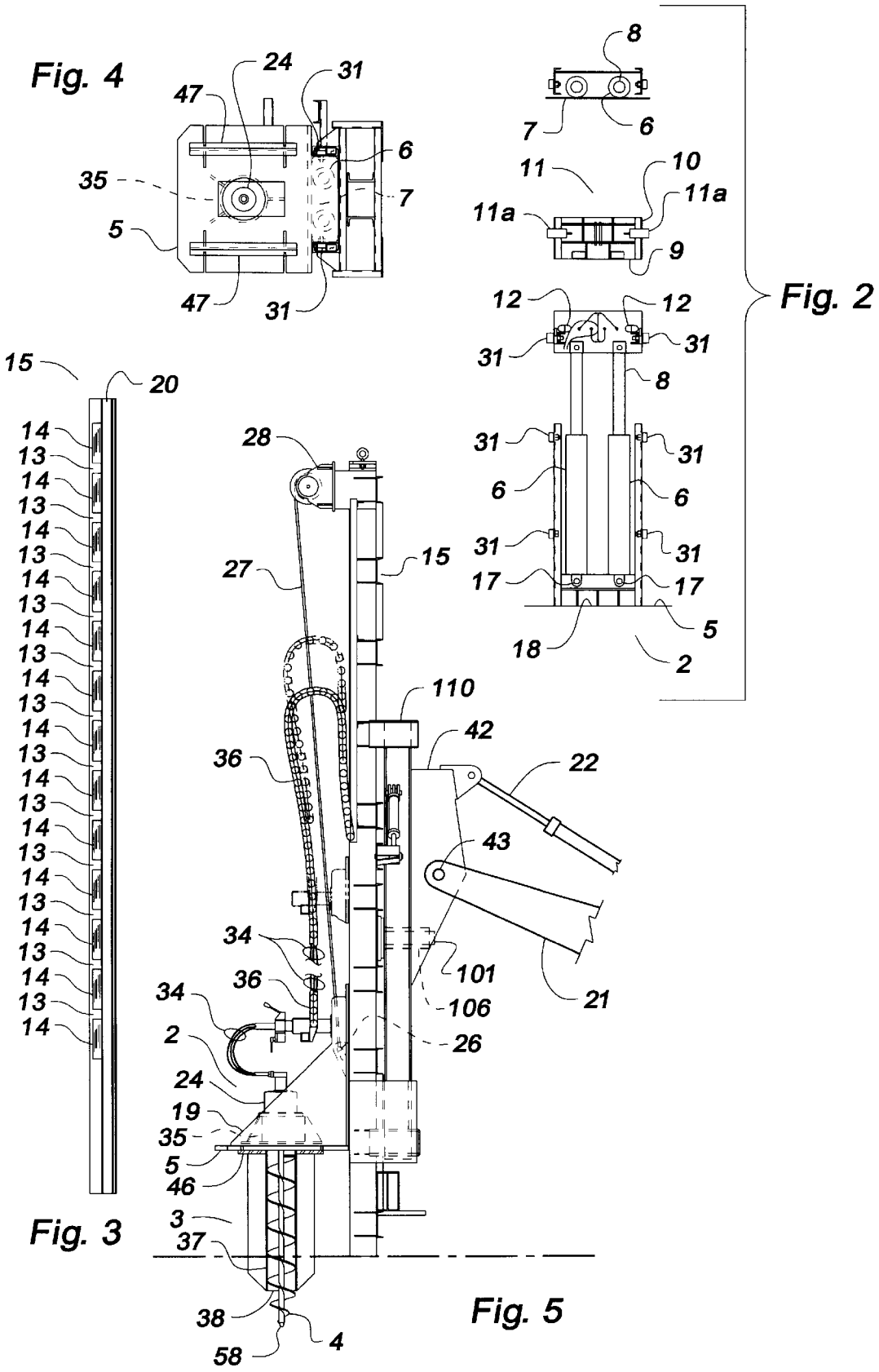
FIG. 2 is a front elevation view, partially cut away, showing the pushing apparatus in accordance with the present invention.
FIG. 3 is a side elevation view showing the tower track of the pushing apparatus in accordance with the present invention.
FIG. 4 is a bottom view showing the push-it carriage in accordance with the present invention.
FIG. 5 is a right side elevation view of a tower apparatus for installing a pipe foundation in the ground in accordance with the present invention, partially showing the tractor attachment.

FIG. 2 shows a front elevation view, partially cut away, of the pushing apparatus in accordance with the present invention. Also shown, behind the sliding back-plate of the pushing/augering carriage, is a portion of two extended piston rods from two respective hydraulic cylinders. A locking dogs mechanism is mounted on a plate frame with wheels on its front plate. FIG. 2 shows an upper pushing plate behind a front plate. Vertical, thrust resistance bars on the tower's inside and cavities created by the vertical bars are provided such that a pair of locking dogs (bars) can lock into the vertical bars.

Referring now to FIG. 2, lower pushing-plate 5 receives its pushing force from a plurality of hydraulic cylinders 6, preferably two or three in number, with their respective piston rods 8 extended, i.e., in the pushing mode. Hydraulic cylinders 6 are mounted on lower pushing-plate 5 behind sliding back-plate 7. Sliding back-plate 7 is attached to lower pushing-plate 5 and is provided with wheels 31. Wheels 31 roll inside channel 20 (FIG. 3) of tower 15 on both sides to allow for a smooth up/down movement of lower pushing-plate 5 and sliding back-plate 7 of carriage 2.

Continuing to refer to FIG. 2, piston rods 8 push upwardly against upper plate 9. Piston rods 8 are attached to upper plate 9 which is part of frame 10. Frame 10 is a rigid, box-like frame made of thick steel plates. Frame 10 houses a set of two locking dogs 11*a*, i.e., locking steel bars 11*a*. Locking dogs operating mechanism 11 actuates the locking dogs 11*a* by means of hydraulic cylinders 12.

Frame 10 containing locking dogs mechanism 11 is provided with four wheels 31. Two of these wheels 31 roll on the outside face on both sides of structural support tower 15. The other two wheels 31 (not shown) roll inside channel 20, also on both sides of tower 15.

FIG. 3 shows a side elevation view of the tower track of the pushing apparatus in accordance with the present invention.

Referring now to FIG. 3, the locking dogs mechanism moves the locking dogs sideways into cavities 13 created by thrust resisting bars 14 which are vertically mounted on tower 15, i.e., structural frame 15. Cavities 13 are spaced at equal intervals of approximately three feet on each side from the top of structural frame 15 down to its bottom. Cavities 13 are the spaces created between each of two vertically adjacent thrust resisting bars 14.

The locking dogs mechanism 11 is mounted on frame 10. An operator, by means of one of several control levers 16 (FIG. 6) or from a remote control box (not shown), actuates hydraulic cylinders 12 which operate the locking dogs mechanism 11.

Operating the locking dogs mechanism by the operator refers to making hydraulic cylinder 12 force the locking dogs (locking bars) 11*a* to move into cavities 13 on both sides of tower 15 so that piston rods 8 can push against upper plate 9. Piston rods 8 push against upper plate 9, which is part of frame 10, which in turn houses the locking bars 11*a*.

The upward thrust of hydraulic cylinders 6 is effectively transferred by means of their piston rods 8 onto structural tower 15 by means of the tower's thrust resisting bars 14 (FIG. 3). These bars are approximately three feet in length and are installed vertically on both sides of the tower 15 at equal intervals from top to bottom, thereby leaving a space between each two cavities 13, i.e., vertically, at equal intervals on both sides of tower 15 from top to bottom. Thrust resistance bars 14 are firmly attached to tower 15, preferably by weldments.

By transferring the powerful, upwardly pushing force of hydraulic cylinders 6 (FIG. 2) by means of their piston rods 8 onto tower 15 (which cannot move up or down), pushing/augering carriage 2 can slide downwardly on tower 15. Pushing/augering carriage 2 will actually receive the resulting pushing force of hydraulic cylinders 6 because bottoms 17 of hydraulic cylinders 6 rest upon and are firmly attached to the back end 18 of lower pushing plate 5. Hydraulic cylinders 6 are positioned behind sliding back-plate 7, which together with reinforcement plates 19 and lower pushing plate 5 form the pushing/augering carriage 2.

The pushing force provided by hydraulic cylinders 6 by means of their piston rods 8 and exerted on pushing/augering carriage 2 pushes foundation 3 into the ground. Hydraulic fluid carrying hoses connect hydraulic cylinders 6 to the system's hydraulic pumps (not shown).

FIG. 4 shows a bottom view of the push-it carriage in accordance with the present invention.

Referring now to FIG. 4, the foundation top-plate attaches to the underside of lower pushing plate 5 of the pushing/augering carriage by means of foundation attachment device 47, while the auger attaches by means of a hexagonal socket (not shown) to a hexagonal power shaft (not shown) from hydraulic motor 24 which protrudes through the underside of lower pushing plate 5.

Foundation attachment device 47 is provided with an adapter plate utilized when smaller size foundations 3 (with or without fins 33) are to be installed by metal foundation push-it and installation machine 1. The adapter plate is removed easily by unbolting it and then lifting it by means of a hydraulic boom lift and lifting eye.

FIG. 5 shows a right side elevation view of a tower apparatus for installing a pipe foundation in the ground in accordance with the present invention, partially showing the tractor attachment. FIG. 5 shows a flexible power track for holding several hydraulic fluid-carrying hoses. FIG. 5 shows a pushing/augering carriage, mounted on the structural tower and a partial view of a hydraulic motor mounted on the pushing augering carriage together with a flexible power track for bringing hydraulic fluid carrying hoses to the hydraulic motor on the carriage.

Referring now to FIG. 5, hydraulic fluid carrying hoses 34 connect hydraulic motor 24 to the tractor hydraulic pumps (not shown) mounted on the tractor 23. Hydraulic hoses 34 are mounted on flexible power track 36, which flexes as carriage 2 moves up or down.

Hydraulic motor 24 is provided with augering spoils outlet 35 for the purpose of expelling soils removed during augering which takes place during the process of pushing foundation 3 into the ground. Pushing/augering carriage 2 also is provided with lifting means for lifting pushing/augering carriage 2 back after foundation 3 has been pushed into the ground and for holding pushing/augering carriage 2 in place when required. Lifting bar 26 is attached to winch cable 27, and cable 27 is attached to winch 28 which is installed at the top end of structural support tower 15.

FIG. 6 shows the tower apparatus of the present invention in the process of installing a conventional metal foundation into the soil. FIG. 6 shows two conventional satellite outboard earthen anchors as described in U.S. Pat. No. 4,843,785. FIG. 6 shows the conventional metal anchors set into the soil and pre-stressed, i.e., with their outwardly swingable compaction and consolidation plates already swung outwardly into the soil. It shows the conventional earthen anchors attached to respective extendably adjustable uplift resistance assemblies/augering guides by means of respective uplift resistance plates and nuts. FIG. 6 shows a pivoting structural support tower in its working position. FIG. 6 shows a pushing/augering carriage with its reinforcement plates, its lower pushing-plate, its sliding back-plate, and its lifting mechanism. FIG. 6 shows a hydraulic motor for augering and its augering spoils outlet. Also shown behind the sliding back-plate of the pushing/augering carriage, is a portion of two partially extended piston rods from two respective hydraulic cylinders. FIG. 6 shows a locking dogs mechanism mounted on a plate frame with wheels on its front plate and rolling against the face of the structural support tower. FIG. 6 shows a pair of locking dogs (bars) to penetrate and lock into the tower. It shows a winch with its hydraulic motor for operating the winch. In addition, it shows a finned pipe foundation with an auger inserted into its pipe column, both mounted on the pushing/augering carriage. It shows several operating control levers, two extendably adjustable, uplift resistance assemblies with augering guides, a container for transporting a remote-operating control box (remote control box not shown) and several hydraulic fluid carrying hoses and connections.

Referring now to FIG. 6, hydraulic motor 29 is utilized for powering winch 28, and it is operated by one of control levers 16 or from a remote control box (not shown). Hydraulic fluid carrying hoses 30 connect hydraulic motor 29 to the tractor's hydraulic pumps (not shown).

The present invention also provides novel extendably adjustable tractor uplift resistance assembly 39. Extendably adjustable uplift resistance assembly 39 is utilized for attaching metal foundation push-it and installation machine 1 by bolting down to conventional outboard earthen anchors 57, e.g., such as described in U.S. Pat. No. 4,843,785 and for guiding an auger for augering an earthen hole for setting earthen anchors 57 therein.

Pushing/augering carriage with hydraulic motor 24, frame 10, including the locking dogs mechanism with locking dogs (bars) hydraulic cylinder 12, hydraulic pistons 8, winch 28 with its hydraulic motor 29, and power track 36 are all installed on the structural support pivoting tower 15 which itself is structurally reinforced by bracings 41.

Tower 15 is a pivoting tower. The operator positions tower 15 initially from the cab of tractor 23. Then the precise positioning is provided by the operator using the remote control box. Cylinder 102 and piston 103 provide the final left to right adjustment to the vertical position.

Steel container 40 is provided for transporting the remote control box and for storage when not being used.

The process of mounting the foundation of the present invent on the underside of carriage 2 by means of attachment device 47 (FIG. 4) is simplified by utilizing a boom lift. Firstly, auger 4 is attached to the hexagonal power-shaft of hydraulic motor 24, also by lifting it and holding it in place until it is attached by means of a hydraulic boom lift. Secondly, foundation 3 is lifted also by the boom lift and placed over auger 4, whereby auger 4 passes through the inside of foundation 3 pipe column 37. Then, while holding foundation 3 in the required position until it is attached, top plate 46 is firmly attached by means of foundation attachment device 47 either to an adapter plate and lower pushing plate 5, if it is a smaller foundation, or directly to lower pushing plate 5, if it is a larger foundation, also by means of attachment device 47. In both cases, the attachment is done by bolting. The attaching of foundation 3 onto pushing/augering carriage 2 by means of attachment device 47 preferably is done with tower 15 in a non-vertical horizontal position.

As described herein above, pushing/augering carriage 2 includes lower pushing plate 5, two side reinforcing plates 19, and sliding back-plate 7 which rests on and is attached to the back end 18 of lower pushing plate 5 and which has wheels 31 on its back side that roll inside channel 20 provided on both sides of tower 15 to allow the entire carriage to move smoothly up and down. In addition, the pushing/augering carriage 2 is provided with a foundation attachment device 47 and a powerful hydraulic motor 24 for rotatably powering auger 4.

The bottoms 17 of hydraulic cylinders 6 are attached to lower pushing plate 5 onto its back end 18 to transfer downwardly onto carriage 2 the pushing force exerted by their piston arms 8 against thrust resisting bars 14. Thrust resisting bars 14 are provided by vertical bars on both sides of tower 15 which resist the upward push of piston rods 8 as they are extended upwardly, out of hydraulic cylinders 6, by hydraulic fluid pumped into the hydraulic cylinders at an operator's commands.

Hydraulic cylinders 6 are operated by the operator by means of control levers 16 or by a remote control box (not shown). All hydraulic and electrical operating functions of the apparatus of the present invention are controlled by the operator by means of control levers 16 or by means of the remote control box.

Referring to FIG. 6, a conventional finned pipe foundation 3 is shown in the process of being installed in the ground by metal foundation push-it and installation machine 1 of the present invention. Foundation 3 is shown already partially pushed into the soil. Foundation 3 can have a plurality of fins, or can be without fins, i.e., a pipe column with a suitable top plate 46 attached to it, generally by weldments. When the foundation installation process begins, tower 15 is preferably lying substantially horizontally. The operator by means of an on board, hydraulically operated boom lift picks up auger 4 and attaches it to hydraulic motor 24 from the underside of lower pushing plate 5. Auger 4 is provided with a conventional kelly bar, hexagonal adapter and pin (both not shown) to couple auger 4 to the hydraulic motor's hexagonal, power shaft (both not shown).

After auger 4 is attached and secured to hydraulic motor 24 located on the pushing/augering carriage 2, the operator proceeds to pick up foundation 3 by means of the hydraulic boom lift and attaches foundation 3 to the underside of lower pushing-plate 5 of carriage 2 by means of foundation attachment device 47 (FIG. 4). The foundation 3 and auger 4 through its pipe column 37 are firmly attached to the underside of pushing augering carriage 2. Next, the operator raises tower 15 from its horizontal position to its working position, i.e., vertically, by means of tractor booms 21.

The operator then must determine whether or not to install satellite earthen anchors 57 when operating to push foundation 3 into the soil. The operator will make that decision based on the size of the foundation and further based on the physical characteristics of the soil from soil tests results available to the operator.

Foundations are designed specifically for supporting loads, resisting overturning moments, and resisting torsional forces. The loads to the supported and moments and forces to be resisted by any foundation and the physical characteristics of the soil where the foundation will be installed determine the size of the foundation and the depth at which it will be pushed into the soil.

Conventional industry practice makes it standard procedure for a foundation contractor to know the physical characteristics of the soil before a foundation is installed.

For harder soils or longer foundations, greater is the force required to push the foundation into the soil. In the process of pushing the foundation downwardly, piston arms 8 (FIG. 2) of hydraulic cylinders 6 push upward against frame 10 which tends to lift metal foundation push-it and installation machine 1 because frame 10 is locked onto tower 15 by means of its locking dog bars. The present invention provides methods and means to prevent the uplifting of the metal foundation push-it and installation machine 1 when required in extreme heavy duty applications. For foundations in soils which are not too hard (accordingly to well known, standard soil classifications), metal foundation push-it and installation machine 1 will push foundation 3 into the soil without requiring installing conventional satellite earthen anchors 57.

Figure 7:
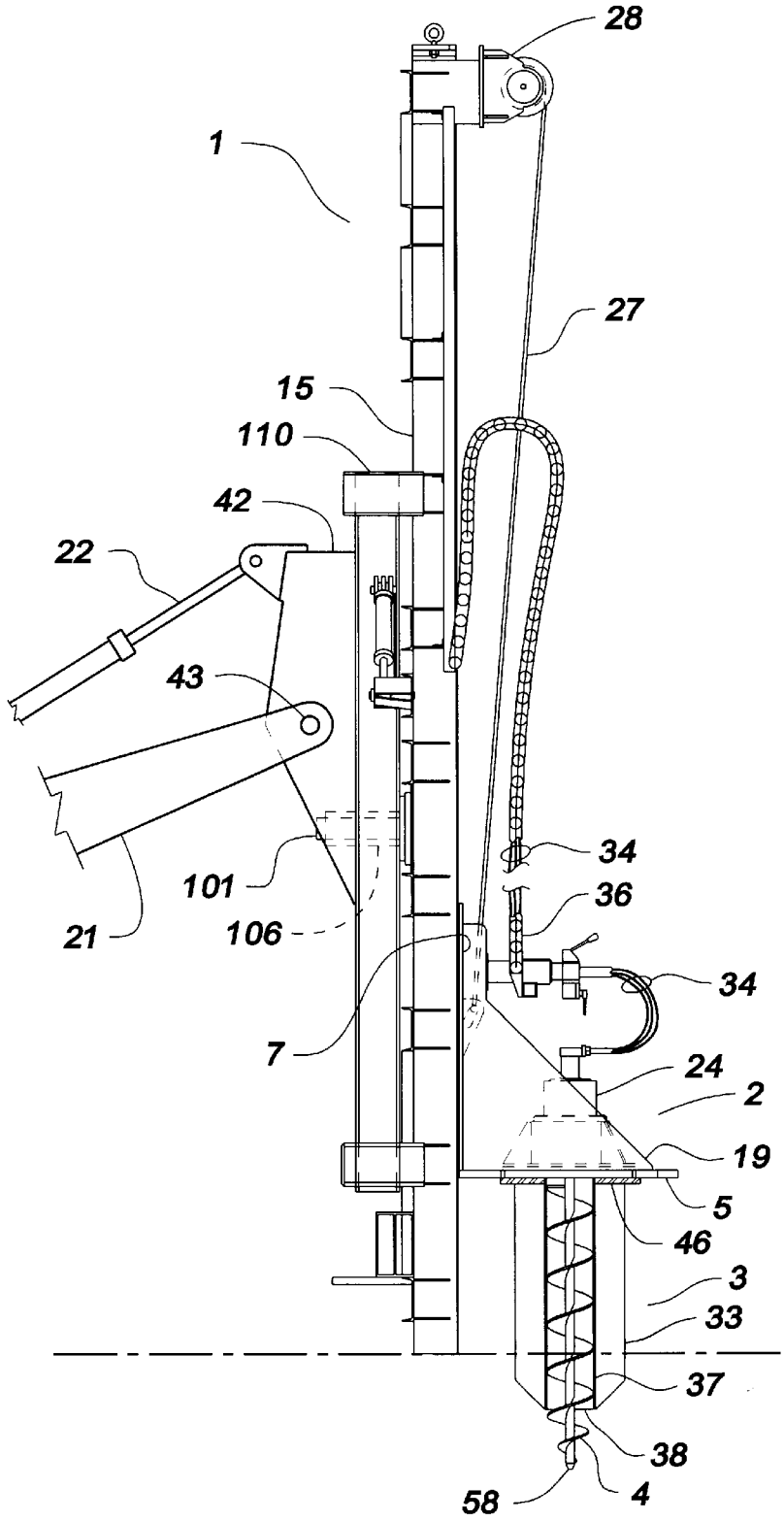
FIG. 7 is a left side elevation view of a tower apparatus for installing a pipe foundation in the ground in accordance with the present invention, partially showing the tractor attachment.

FIG. 7 shows a left side elevation view of a tower apparatus for installing a pipe foundation in the ground in accordance with the present invention, partially showing the tractor attachment.

FIG. 8 shows a rear elevation view of a tower apparatus for installing a pipe foundation in the ground in accordance with the present invention, partially showing the tractor attachment point and hydraulic positioning apparatus.

Figure 9:
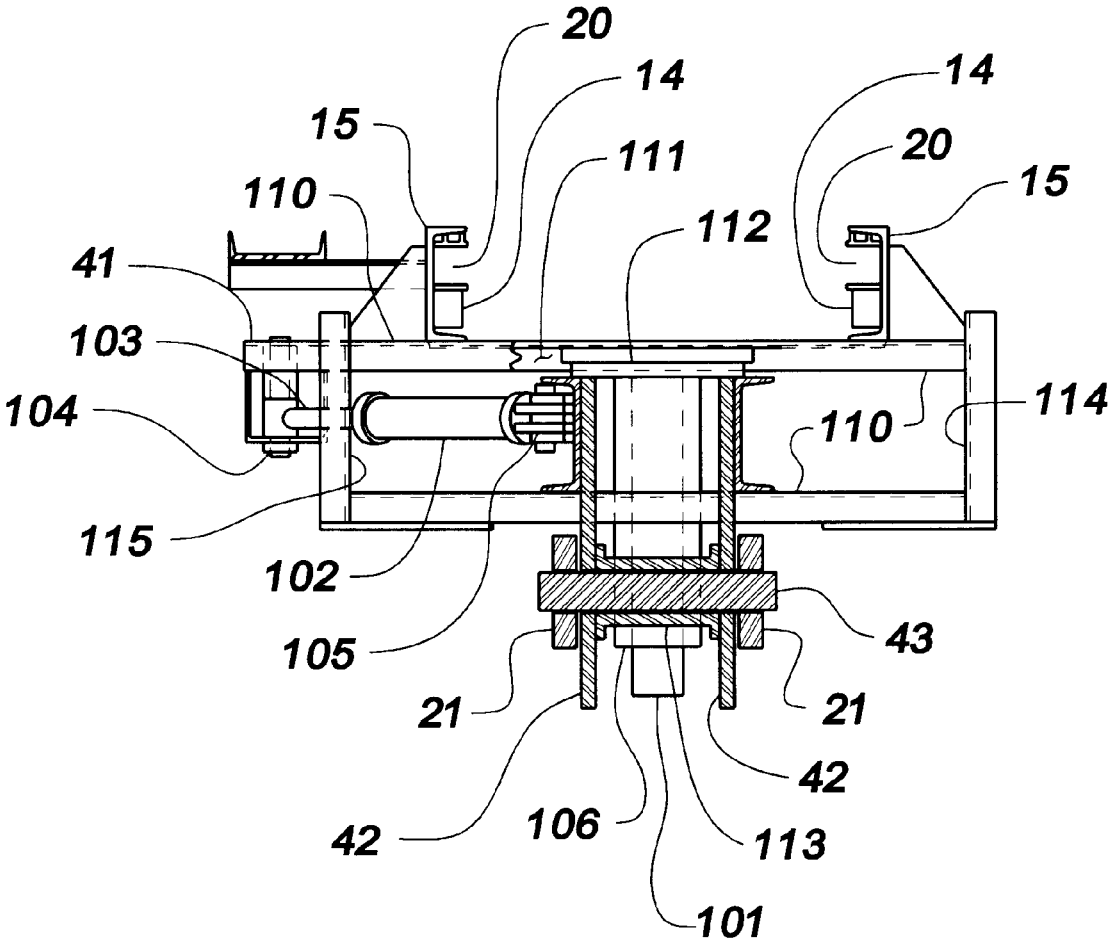
FIG. 9 is a top view of a slider box of a tower apparatus for installing a pipe foundation in the ground in accordance with the present invention.

FIG. 9 shows a top view of a slider box 110 of the tower apparatus for installing a pipe foundation in the ground in accordance with the present invention. Slider box 110 has slider box end 114 and slider box end 115. Cylinder 102 has piston 103 anchored at anchoring point 104 and anchoring point 105. Pin 101 is welded to tower structural cross bracing 111 at area 112. When tower 15 rotates, e.g., to the left as viewed in FIG. 9, slider box end 114 could hit tractor adapter assembly 42, unless stopped by the operator. Bushing support plates 113 are welded to tractor adapter assembly 42. Tower cross bracing 41 is depicted below slider box 110, i.e., at a horizontal plane lower on tower 15 than slider box 110.

Referring back to FIG. 1, the operator positions the tractor booms and the tower so as to locate auger 4 and foundation 3 over the correct location where foundation 3 will be installed by the apparatus of the present invention. The operator then proceeds to set metal foundation push-it and installation machine 1 to a leveled position.

This is the method the operator applies for pushing a foundation down into the soil. The operator lowers pushing/augering carriage 2 to a point where the tip 58 of auger 4 is very close to the soil. The operator by means of the remote control box or via control levers 16 (FIG. 6) operates hydraulic cylinder 12 (FIG. 2) by extending its piston rod to make the locking dogs mechanism 11 pull the locking dogs (bars) 11*a* out of cavities 13 (FIG. 3) on both sides of tower 15. By unlocking the bars out of cavities 13, frame 10 is free to move on wheels 31 which roll on the face 32 of tower 15 and on wheels 31 which roll inside channel 20.

When the locking bars 11*a* from locking dogs mechanism 11 unlock out of cavities 13, pushing/augering carriage 2 carrying hydraulic cylinders 6 on the back end of its lower pushing plate 5, and frame 10 attached to piston rods 8, are free to move on its wheels 31 which roll inside channel 20 (FIG. 3). Nevertheless, pushing/augering carriage 2 cannot move down because it is firmly held in place by cable 27 of winch 28. If it was not held in place, it would rapidly fall. Now the operator from the remote control box or via control levers 16 operates cylinders 6 (FIG. 2) and makes the respective piston rods 8 retract into the respective cylinders 6, thereby pulling down to a lower position frame 10 which contains the locking dogs mechanism 11 and the locking dog bars 11*a*.

Then the operator from the remote control box or from levers 16 reverses the flow of hydraulic fluid in cylinder 12 making its piston rod retract which, in turn, by means of locking dog mechanism 11 forces the locking dogs bars 11*a* into a new set of cavities 13 at the lower position to where frame 10 was pulled down by piston rods 8 when they were made to retract into their respective cylinders 6 by the operator.

One end of the locking bars 11*a* then has penetrated into a respective cavity 13, one at each side of tower 15. The other end is attached firmly to the locking dogs mechanism 11 and therefore to frame 10. Cavities 13 are made of each set of two thrust resisting, vertically attached bars 14. Therefore, by moving the locking bars 11*a* into this new set of cavities 13, frame 10 cannot move up or down. Frame 10 is immobilized in that position.

Now the operator can make cylinders 6 via their respective piston rods 8 push against this fixed, immobilized frame 10. But first, the operator releases winch 28 via the remote control box or via control levers 16 to allow pushing because carriage 2 to move because of the push exerted by piston rods 8 against upper pushing plate 9. Carriage 2 cannot free-fall because the dogging bars 11*a* are now locked in a new set of cavities 13, thereby to prevent free-falling.

The operator now lowers pushing/augering carriage 2 by means of the remote control box or levers 16. The operator activates hydraulic cylinders 6, i.e., to make hydraulic fluid flow into the cylinders in the direction that pushes their respective pistons rods 8 out of their respective cylinders. Because piston rods 8 are firmly attached to upper pushing plate 9 of frame 10 and because frame 10 is locked in place by its locking dog (bars) 11*a* preventing frame 10 from moving, the pushing force of hydraulic cylinders 6 is exerted on the pushing/augering carriage 2, effectively pushing it downwardly.

If the pushing/augering carriage 2 with foundation 3 and auger 4 attached to it are farther up on tower 15, more than one lowering cycle may be required. On each lowering cycle, pushing/augering carriage 2 can only be lowered for a distance equal to the distance between cavities 13, e.g., such as, approximately three feet. This distance bears a relationship to the maximum stroke provided by hydraulic cylinders 6, i.e., the maximum length piston rods 8 can extend out of their respective cylinders 6.

Now, therefore, the augering/pushing carriage 2 with auger 4 and foundation 3 attached to the carriage have been lowered to a point where the tip 58 of auger 4 is very close to the soil. By repeating these pushing cycles, the foundation is pushed into the soil if it was a smaller foundation or softer soils not requiring uplift resistance means.

Next the operator proceeds to set in the soil two conventional outboard satellite earthen anchors 57 (FIG. 6) all in accordance with the apparatus and methods described in U.S. Pat. No. 4,843,785. These earthen anchors 57 are to be attached to the extendably adjustable uplift resistance assembly 39 provided by the present invention.

When two satellite anchors 57 are set in the soil and their outwardly swingable compaction and consolidation plates 59 have been outwardly swung, i.e., stressed against the soil in earthen hole 67 and prior to removing their installation apparatus (not shown), uplift resistance nut 60 is tightened against uplift resistance plate 61 set upon guide 62. Uplift resistance nut 60 threads on threaded rod 63 of conventional earthen anchor 57 which, in turn, holds spreader cone 64 in place which, in turn, keeps outwardly swingable compaction and consolidation plates 59 stressed against the soil, i.e., exerting great force against the soil. Each earthen anchor 57 has four such plates 59 at approximately ninety degrees from each other.

Extendably adjustable uplift resistance assembly 39 includes structural arm guide 65, adjustable sliding arm 66, augering guide 62, and a pair of hydraulic cylinders (not shown) inside structural arm guide 65. Such hydraulic cylinders are utilized by the operator to extend the adjustable sliding arms 66 to the desired position where earthen anchors 57 are to be placed. Such hydraulic cylinders are operated from the remote control box or from control levers 16.

When two satellite anchors 57 are stressed against the soil and firmly attached to uplift resistance assembly 39 by means of uplift resistance nut 60 and uplift resistance plate 61, metal foundation push-it and installation machine 1 is ready for pushing foundation 3 into the soil by means of pushing/augering carriage 2.

As pushing/augering carriage 2 pushes foundation 3 downwardly, auger 4 augers an earthen hole ahead of the advance of bottom end 38 of foundation 3 into the soil. Auger 4 extends approximately two feet beyond bottom end 38 of foundation 3.

The force exerted by piston arms 8 of hydraulic cylinders 6 on top plate 46 of foundation 3 is resisted by the soil in which the foundation is being pushed. The resistance is transmitted to tower 15 via the locking dog bars contained in frame 10, pushing against thrust resistance bars 14. This soil resistance in some extreme cases is greater than the downward force provided by the weight of push-it machine 1, and therefore, the force provided by hydraulic cylinders 6 would uplift the push-it machine 1 for extremely larger foundations or for extremely hard soils.

Nevertheless, this uplift is resisted by the novel, extendably adjustable uplift resistance assembly 39 which is anchored to the soil via two satellite earthen anchors 57. The uplift resistance capacity of the uplift resistance assembly 39, when attached to earthen anchors 57 and the pushing force provided by hydraulic cylinders 6 are individually greater than the resistance the soil can exert against the push of foundation 3 into it, and therefore, foundation 3 is pushed effectively into the soil by piston rods 8 of hydraulic cylinders 6.

Foundation 3 is pushed at intervals of approximately three feet at a time because of the maximum stroke length provided by hydraulic cylinders 6.

After each pushing interval, the dogging bars 11*a* have to be disengaged by means of hydraulic cylinder 12 and mechanisms 11 from cavities 13. Frame 10 which contains the dogging bars must be lowered by retracting piston arms 8 back into their respective hydraulic cylinders 6. Piston arms 8 are firmly attached by weldments or by other means to frame 10. For that reason, piston arms 8 pull down frame 10 when they retract into their respective cylinders 6. Frame 10 is pulled down to the top end of sliding plate 7, and at that level, the operator re-engages the dogging bars 11*a* into a new set of cavities 13 and releases winch 28. Now a new downwardly pushing cycle can commence. All operations are commanded by the operator either from control levers 16 or from a remote control box connected to metal foundation push-it and installation machine 1 by a conventional umbilical cord (not shown).

After the foundation has been pushed into the soil, earthen anchors 57 are removed by the operator with the help of a boom lift.

The present invention provides the method and means for boring earthen holes 67 required for installing earthen anchors 57. The present invention provides a hydraulic motor for powering a conventional auger which is utilized for augering earthen hole 67. Auger 69 is provided with a cutting head and augering teeth. Auger 69 is attached to a hexagonal power shaft of the hydraulic motor by means of a hexagonal coupling and pin. The coupling is attached by weldments to an auger kelly bar.

The hydraulic motor is provided with attachment plates which attach to a boom lift by means of an attachment plate assembly and pin. Hydraulic fluid is pumped to and from the hydraulic motor through hydraulic hoses. The operation of the hydraulic motor is controlled by the operator from control levers 16 or from the remote control box.

The operator picks up auger 69 by means of a boom lift and places it through augering guide 62 of the extendably adjustable uplift resistance assembly 39. Adjustable sliding arm 66 has been extended first to the required position by the operator. Next, the operator lowers the boom lift by means of control lever 16 to a point where the operator manually attaches the hydraulic motor to the attachment plate assembly of the boom lift by means of a pin.

The operator now moves the boom lift carrying the hydraulic motor in such a manner to insert the motor's hexagonal power shaft into a coupling. Generally, an operator and a helper are utilized for all the operations of metal foundation push-it and installation machine 1. Next, the auger is secured to the hydraulic motor by means of a pin.

The operator now verifies the plumb of auger 69 by means of a conventional level to assure a vertical earthen hole 67 is bored by metal foundation push-it and installation machine 1. Augering guide 62 helps to maintain auger in a vertical position.

Now the operator augers the earthen hole to the required depth by operating the hydraulic motor and applying some downward pressure from the boom lift upon the hydraulic motor. When boring is complete, the operator reverses the rotation of the hydraulic motor and lifts it, thereby carrying the auger along with it out of earthen hole 67. All of these operations are commanded from control levers 16 or from a remote control box.

The entire operation is repeated for the second earthen hole 67 required for the second earthen anchor 57. Then the auger, the hydraulic motor, and the attachment plate assembly can be removed from the boom lift.

The present invention provides an auger utilized as earthen anchors. Auger anchors can replace earthen anchors 57 for installing certain medium size foundations which can be installed with or without fins. Auger anchors are the type of augers which screw into soils without lifting up earthen spoils, i.e., without boring an earthen hole. Therefore they remain firmly anchored to the soil, i.e., firmly screwed into the soil.

Depending on the soil classification from soil test results which are normally available to the operator and depending on the length of the foundation to be installed, the operator determines the length of the auger anchor required to be screwed into the soil, one for each uplift resistance assembly 39.

The operator can proceed now to push the foundation into the soil with respect to the downwardly push from pushing/augering carriage 2 provided by a plurality of hydraulic cylinders exerting their thrust against one or more thrust resistance bars. Thrust exerted by the hydraulic cylinders is exerted first against the bottom plate of a locked-in-place frame locked-in against the thrust resistance bars by means of the frame's locking dog bars. These locking dog bars have the capability of being moved in/out of their locked-in position by means of a mechanism powered by hydraulic means. This mechanism has the capability of being moved up or down by hydraulic means to achieve new locked-in positions at lower levels as the foundation is pushed into the ground. All steps are controlled by an operator from a set of control levers or from a remote control box connected to the apparatus by an umbilical cord.

After the operator has completed pushing the foundation into the soil, the operator removes the auger anchors by reversing their installations process and with the assistance of the boom lift.

Thus it can be seen that the invention accomplishes all of its objectives.

The present invention includes a novel heavy duty mobile, tractor-mounted metal foundation positioning, push-it, and installation machine for installing prefabricated, longitudinally-finned, cylindrical metal foundations into the ground by positioning and pushing the metal foundations through pushing forces provided by hydraulic cylinders mounted on the heavy duty mobile, tractor-mounted metal foundation positioning, push-it, and installation machine.

The heavy duty mobile tractor-mounted machine can be a tractor having a large, heavy duty undercarriage having tracks, track rollers, and car body such as available from Caterpillar, e.g., in one embodiment, a Caterpillar™ 350 Excavator.

The present invention includes apparatus and method for providing a novel metal foundation push-it and installation machine which includes a tractor-mounted tower for holding a push-it carriage including metal foundation holder and auger. The novel machine and method of the present invention augers a hole and installed the metal foundation in one step as the push-it carriage is pushed toward the ground.

Hydraulic pushing cylinders push against a bar held in adjustable bar securing positions on the tower, i.e., the hydraulic cylinders push against a bar secured to the side frame of the tower. After the hydraulic cylinders extend to a maximum extension, the bar can be advanced to a lower position in the side frame of the tower, and the hydraulic cylinder assembly is lowered so that it can push against the bar in its lower position.

The present invention includes apparatus and method for providing a novel metal foundation push-it and installation machine which includes outboard or satellite anchors or auger anchors to hold down the tractor when the foundation is pushed into the ground. A tractor-mounted extensible satellite anchor augering guide and anchor structural support extends and retracts on both sides of the tractor.

The present invention includes apparatus and method for providing a novel metal foundation push-it and installation machine and method which do not use or require a preliminary and separate augering step, a separate crane to move the foundation into position or to move the hydraulic pushing mechanism into position, or a central anchor inside the foundation.

Although the invention has been illustrated by the preceding actual examples, it is not to be construed as being limited to the materials or procedures employed therein.

Whereas particular embodiments of the invention have been described in detail herein above, for purposes of illustration, it will be evident to those skilled in the art that numerous variations of the details may be made without departing from the invention as defined in the appended claims.

The apparatus and process of the present invention are not limited to the descriptions of specific embodiments presented herein above, but rather should be viewed in terms of the claims that follow and equivalents thereof. Further, while the invention has been described in conjunction with several such specific embodiments, it is to be understood that many alternatives, modifications, and variations will be apparent to those skilled in the art in light of the foregoing detailed descriptions. Accordingly, this invention is intended to embrace all such alternatives, modifications, and variations which fall within the spirit and scope of the appended claims.

What is claimed is:

1. A heavy duty pipe-column-type metal foundation installation apparatus, comprising:

(a.) a tower;

(b.) a pipe-column-type metal foundation holder supported on said tower, said metal foundation having a cylindrical pipe-column-type body and longitudinal fins welded vertically along-side said cylindrical pipe-column-type body;

(c.) a push-it carriage movably supported on said tower for providing controllably movable positioning to said cylindrical pipe-column-type metal foundation holder;

(d.) hydraulic pushing cylinders on said push-it carriage for pushing against a header frame held in adjustable securing positions on said tower;

(e.) an auger aligned below said push-it carriage and inside said cylindrical pipe-column-type metal foundation for drilling a hole in the ground in advance of pushing said cylindrical pipe-column-type metal foundation from said metal foundation holder into the ground, and (f.) means for holding said tower on a track roller frame tractor structure.

2. A heavy duty pipe-column-type metal foundation installation apparatus, as set forth in claim 1, wherein said means for holding said tower on a track roller frame tractor structure further comprises means for positioning said tower.

3. A heavy duty pipe-column-type metal foundation installation apparatus, as set forth in claim 1, wherein said means for holding and position said tower on a track roller frame tractor structure comprises a hydraulically activated tractor boom arm, a pivot attachment point on said tower, and hydraulic cylinders for rotating said tower about said pivot point.

4. A heavy duty pipe-column-type metal foundation installation apparatus, as set forth in claim 1, wherein said cylindrical pipe-column-type foundation having longitudinal fins welded vertically alongside said cylindrical pipe column body further comprises an integral top plate for mounting a sign, high mast lighting or utility pole, or communication tower.

5. A heavy duty pipe-column-type metal foundation installation apparatus, as set forth in claim 1, wherein said metal foundation holder further comprises means for holding and securing said metal foundation integral top plate.

6. A heavy duty pipe-column-type metal foundation installation apparatus, as set forth in claim 1, further comprising:

(g.) outboard satellite anchors to hold down said tower when said cylindrical pipe-column-type metal foundation is pushed into the ground.

7. A heavy duty pipe-column-type metal foundation installation apparatus, as set forth in claim 6, further comprising:

(h.) an extensible satellite anchor augering guide and anchor structural support aligned to extend and retract on both sides of said tower.

8. A heavy duty pipe-column-type metal foundation installation apparatus, as set forth in claim 1, wherein said hydraulic pushing cylinders on said push-it carriage for pushing against a header frame held in adjustable securing positions on said tower further comprise piston rods for pushing against said header frame controllably adjustably held and secured to the side frame of said tower such that after said hydraulic cylinders extend to a maximum extension, said header frame can be advanced to a lower position in the side frame of the tower, further wherein said hydraulic cylinders are adapted to be lowered such that they push against said header frame held in a lower position on said tower.

9. A heavy duty pipe-column-type metal foundation installation apparatus, as set forth in claim 1, wherein said tractor comprise a Caterpillar™ 350 excavator.

10. A heavy duty pipe-column-type metal foundation installation apparatus, as set forth in claim 6, wherein said satellite anchor comprises a cork-screw-type auger anchor or an extendable bottom plate anchor.

11. A method of installing a cylindrical pipe-column-type metal foundation in the ground, comprising:

(a.) providing a tower;

(b.) holding a cylindrical pipe-column-type metal foundation on said tower, said metal foundation having an integral top plate for mounting a sign, high mast lighting or utility pole, or communication tower on said cylindrical metal foundation and further having longitudinal fins welded vertically alongside said cylindrical pipe column;

(c.) attaching said tower to a track roller frame tractor structure; and (d.) drilling a hole in the ground directly below and inside said cylindrical pipe-column-type metal foundation in advance of pushing said cylindrical pipe-column-type metal foundation into the ground, wherein said drilling and pushing are performed in one step.

12. A method of installing a cylindrical pipe-column-type metal foundation in the ground, as set forth in claim 11, wherein said attaching comprises positioning said tower for said drilling and pushing.

13. A method of installing a cylindrical pipe-column-type metal foundation in the ground, as set forth in claim 12, wherein said positioning said tower comprises providing a hydraulically activated tractor boom arm, a pivot attachment point on said tower, and hydraulic cylinders for rotating said tower about said pivot point.

14. A method of installing a cylindrical pipe-column-type metal foundation in the ground, as set forth in claim 11, further comprising providing on said pipe-column-type foundation an integral top plate for mounting a sign, high mast lighting or utility pole, or communication tower.

15. A method of installing a cylindrical pipe-column-type metal foundation in the ground, as set forth in claim 11, further comprising holding and securing said metal foundation integral top plate.

16. A method of installing a cylindrical pipe-column-type metal foundation in the ground, as set forth in claim 11, further comprising holding down said tower by outboard satellite anchors when said cylindrical pipe-column-type metal foundation is pushed into the ground.

17. A method of installing a cylindrical pipe-column-type metal foundation in the ground, as set forth in claim 11, further comprising providing an extensible satellite anchor augering guide and anchor structural support aligned to extend and retract on both sides of said tower.

18. A method of installing a cylindrical pipe-column-type metal foundation in the ground, as set forth in claim 11, further comprising providing hydraulic pushing cylinders on said push-it carriage for pushing against a header frame held in adjustable securing positions on said tower further comprising piston rods for pushing against said header frame controllably adjustably held and secured to the side frame of said tower such that after said hydraulic cylinders extend to a maximum extension, said header frame can be advanced to a lower position in the side frame of the tower, further wherein said hydraulic cylinders are adapted to be lowered such that they push against said header frame held in a lower position on said tower.

19. A method of installing a cylindrical pipe-column-type metal foundation in the ground, as set forth in claim 11, further comprising providing outboard satellite anchors to hold down said tower when said cylindrical pipe-column-type metal foundation is pushed into the ground.

20. A heavy duty pipe-column-type metal foundation installation apparatus, comprising:

(a.) a tower;

(b.) a pipe-column-type metal foundation holder supported on said tower, said metal foundation having a cylindrical pipe-column-type body, longitudinal fins welded vertically alongside said cylindrical pipe-column-type body, and an integral top plate for mounting a sign, high mast lighting or utility pole, or communication tower;

(c.) a push-it carriage movably supported on said tower for providing controllably movable positioning to said cylindrical pipe-column-type metal foundation holder;

(d.) hydraulic pushing cylinders on said push-it carriage for pushing against a header frame held in adjustable securing positions on said tower;

(e.) an auger aligned below said push-it carriage and inside said cylindrical pipe-column-type metal foundation for drilling a hole in the ground in advance of pushing said cylindrical pipe-column-type metal foundation from said metal foundation holder into the ground;

(f.) means for holding and positioning said tower on a track roller frame tractor structure, comprising two hydraulically activated tractor boom arms, two pivot points on said tower, and hydraulic cylinders for rotating said tower about said pivot attachment points;

(g.) outboard satellite anchors to hold down said tower when said cylindrical pipe-column-type metal foundation is pushed into the ground; and (h.) an extensible satellite anchor augering guide and anchor structural support aligned to extend and retract on both sides of said tower.

* * * * *